US011094485B2

(12) United States Patent
Delpozzo et al.

(10) Patent No.: US 11,094,485 B2
(45) Date of Patent: Aug. 17, 2021

(54) MEDIUM VOLTAGE CONTACTOR

(71) Applicant: ABB Schweiz AG, Baden (CH)

(72) Inventors: Andrea Delpozzo, Torbiato di Adro (IT); Emanuele Morelli, Linarolo (IT); Veronica Biagini, Ladenburg (DE); Osvaldo Prestini, Nembro (IT)

(73) Assignee: ABB Schweiz AG, Baden (CH)

( * ) Notice: Subject to any disclaimer, the term of this patent is extended or adjusted under 35 U.S.C. 154(b) by 87 days.

(21) Appl. No.: 16/336,141

(22) PCT Filed: Jul. 26, 2017

(86) PCT No.: PCT/EP2017/068850
§ 371 (c)(1),
(2) Date: Mar. 25, 2019

(87) PCT Pub. No.: WO2018/059791
PCT Pub. Date: May 4, 2018

(65) Prior Publication Data

US 2019/0252140 A1 Aug. 15, 2019

(30) Foreign Application Priority Data

Sep. 29, 2016 (EP) ..... 16191442

(51) Int. Cl.
*H01H 33/38* (2006.01)
*H01H 33/666* (2006.01)
(Continued)

(52) U.S. Cl.
CPC ..... *H01H 33/666* (2013.01); *H01H 33/285* (2013.01); *H01H 33/38* (2013.01); *H01H 33/6662* (2013.01); *H01H 33/022* (2013.01)

(58) Field of Classification Search
CPC ..... H01H 33/285; H01H 33/666; H01H 33/6662; H01H 33/38
See application file for complete search history.

(56) References Cited

U.S. PATENT DOCUMENTS 3,503,022 A 3/1970 Burdett
6,066,999 A * 5/2000 Pischinger ..... F01L 9/04 335/226
(Continued)

FOREIGN PATENT DOCUMENTS

CN 101908420 A 12/2010
DE 102011081921 A1 2/2013
(Continued)

OTHER PUBLICATIONS

European Patent Office, International Search Report & Written Opinion issued in corresponding Application No. PCT/EP2017/068850, dated Nov. 23, 2017, 15 pages.
(Continued)

*Primary Examiner* — Ramon M Barrera
(74) *Attorney, Agent, or Firm* — Taft Stettinius & Hollister LLP

(57) ABSTRACT

A contactor for medium voltage electric systems including: one or more electric poles; for each electric pole, a fixed contact and a corresponding movable contact reversibly movable between a first position, at which the movable contact is decoupled from the fixed contact, and a second position, at which the movable contact is coupled with the fixed contact; an electromagnetic actuator including a magnetic yoke having a fixed yoke member and a movable yoke member, the movable yoke member reversibly movable between a third position corresponding to the first position of the movable contacts, at which the movable yoke member is decoupled from the fixed yoke member, and a fourth position, corresponding to the second position of the movable contacts, at which the movable yoke member is coupled with the fixed yoke member, the electromagnetic actuator including an excitation circuit assembly including an excitation coil wound around the magnetic yoke and electrically connected with an auxiliary electric power supply to be fed with an excitation current to generate an excitation magnetic
(Continued)

flux to move the movable yoke member from the third position to the fourth position or to maintain the movable yoke member in the fourth position; an opening springs operatively coupled with the movable yoke member to move the movable yoke member from the fourth position to the third position; a kinematic chain to operatively connect said movable yoke member with said movable contacts. The electromagnetic actuator including camping circuit assembly comprising a damping coil arranged to form a conductive loop adapted to be at least partially enchained with the excitation magnetic flux generated by the excitation current flowing along the excitation coil, when the auxiliary electric power supply provides the excitation current to the excitation coil, so that a secondary current circulates along the damping coil when the excitation magnetic flux is subject to a transient.

23 Claims, 12 Drawing Sheets

(51) Int. Cl.
*H01H 33/28* (2006.01)
*H01H 33/02* (2006.01)

(56) References Cited

U.S. PATENT DOCUMENTS

| | | | | |
|---|---|---|---|---|
| 8,912,871 | B2 | 12/2014 | Lauraire et al. | |
| 2016/0099123 | A1 | 4/2016 | Ohda et al. | |
| 2017/0110274 | A1* | 4/2017 | Hahn | H01H 47/22 |

FOREIGN PATENT DOCUMENTS

| | | | |
|---|---|---|---|
| EP | 1619707 | A1 | 1/2006 |
| WO | 2011000744 | A1 | 1/2011 |
| WO | 2011073539 | A1 | 6/2011 |
| WO | 2015098145 | A1 | 7/2015 |

OTHER PUBLICATIONS

European Patent Office, Extended Search Report issued in corresponding Application No. 16191442.9, dated Jan. 30, 2017, 15 pages.

* cited by examiner

MEDIUM VOLTAGE CONTACTOR

The present invention relates to a contactor (e.g. a vacuum contactor) for medium voltage electric systems.

For the purpose of the present application, the term "medium voltage" (MV) relates to operating voltages at electric power distribution levels, which are higher than 1 kV AC and 1.5 kV DC up to some tens of kV, e.g. up to 72 kV AC and 100 kV DC.

As is known, MV electric systems typically adopt two different kinds of switching devices.

A first type of switching devices, including for example circuit breakers, is basically designed for protection purposes, namely for carrying (for a specified time interval) and breaking currents under specified abnormal circuit conditions, e.g. under short circuit conditions.

A second type of switching devices, including for example contactors, is basically designed for manoeuvring purposes, namely for carrying and breaking currents under normal circuit conditions including overload conditions.

MV vacuum contactors represent a widely used type of MV contactors.

These apparatuses are suitable for installation in harsh environments (such as in industrial and marine plants) and are typically used in control and protection of motors, transformers, power factor correction banks, switching systems, and the like.

Normally, a MV vacuum contactor comprises, for each electric pole, a vacuum bulb in which the electrical contacts are placed to mutually couple/decouple upon actuation by a suitable actuating device.

Some MV vacuum contactors of the state of the art (bi-stable contactors) adopt an electromagnetic actuator to move the movable contacts from a decoupled position to a coupled position with respect to the fixed contacts (closing manoeuvre of the contactor), and from a coupled position to a decoupled position with respect to the fixed contacts (opening manoeuvre of the contactor).

Examples of these MV vacuum contactors are disclosed in patent applications EP1619707A1 and WO2011/000744.

Other MV vacuum contactors of the state of the art (mono-stable contactors) adopt an electromagnetic actuator to move the movable contacts from a decoupled position to a coupled position with respect to the fixed contacts (closing manoeuvre of the contactor) and to hold the movable contacts in said coupled position (closing state of the contactor). Differently from bi-stable contactors, these apparatuses comprise opening springs to move the movable contacts from a coupled position to a decoupled position with respect to the fixed contacts (opening manoeuvre of the contactor).

Said opening springs are normally arranged in such a way to store elastic energy during a closing manoeuvre of the contactor and release the stored elastic energy to move the movable contacts during an opening manoeuvre of the contactor.

As is known, the opening springs of a contactor are typically designed to withstand the attraction force exerted on the movable contacts due to the differential pressure between the internal volume of the vacuum bulbs and the external environment, when the contactor is an opening state.

This means that the opening springs often store a higher elastic energy than the minimum amount required to perform an opening manoeuvre.

Therefore, during an opening manoeuvre of the contactor, the movable contacts may be moved with a speed higher than necessary.

This often entails some drawbacks that may jeopardize the overall reliability of the contactor. As an example, during an opening manoeuvre of the contactor, remarkable mechanical stresses may be exerted on some components of the contactor, e.g. on the sealing bellows operatively associated with the vacuum bulbs.

As a further example, during an opening manoeuvre of the contactor, the movable contacts may be subject to undesired over-travelling or back-travelling movements, which may lead to dangerous changes of the dielectric distances between the parts.

In some solutions of the state of the art, the kinematic chain, which transmits motion to the movable contacts, is provided with mechanical dampers or stoppers to reduce the actuation forces exerted on the movable contacts, particularly during an opening manoeuvre of the contactor.

However, these solutions generally entail a remarkable structural complication of such kinematic chain.

Further, mechanical dampers or stoppers are often subject to considerable aging and deterioration phenomena.

The main aim of the present invention is to provide a contactor for medium voltage electric systems that allows solving or mitigating the above-mentioned problems.

More in particular, it is an object of the present invention to provide a contactor having high levels of reliability for the intended applications.

As a further object, the present invention is aimed at providing a contactor having a relative simple and space-saving structure.

Still another object of the present invention is to provide a contactor that can be easily manufactured at industrial level, at competitive costs with respect to the solutions of the state of the art.

In order to fulfill these aim and objects, the present invention provides a contactor, according to the following claim 1 and the related dependent claims.

Characteristics and advantages of the invention will emerge from the description of preferred, but not exclusive embodiments of the contactor, according to the invention, non-limiting examples of which are provided in the attached drawings, wherein.

Figure 8:
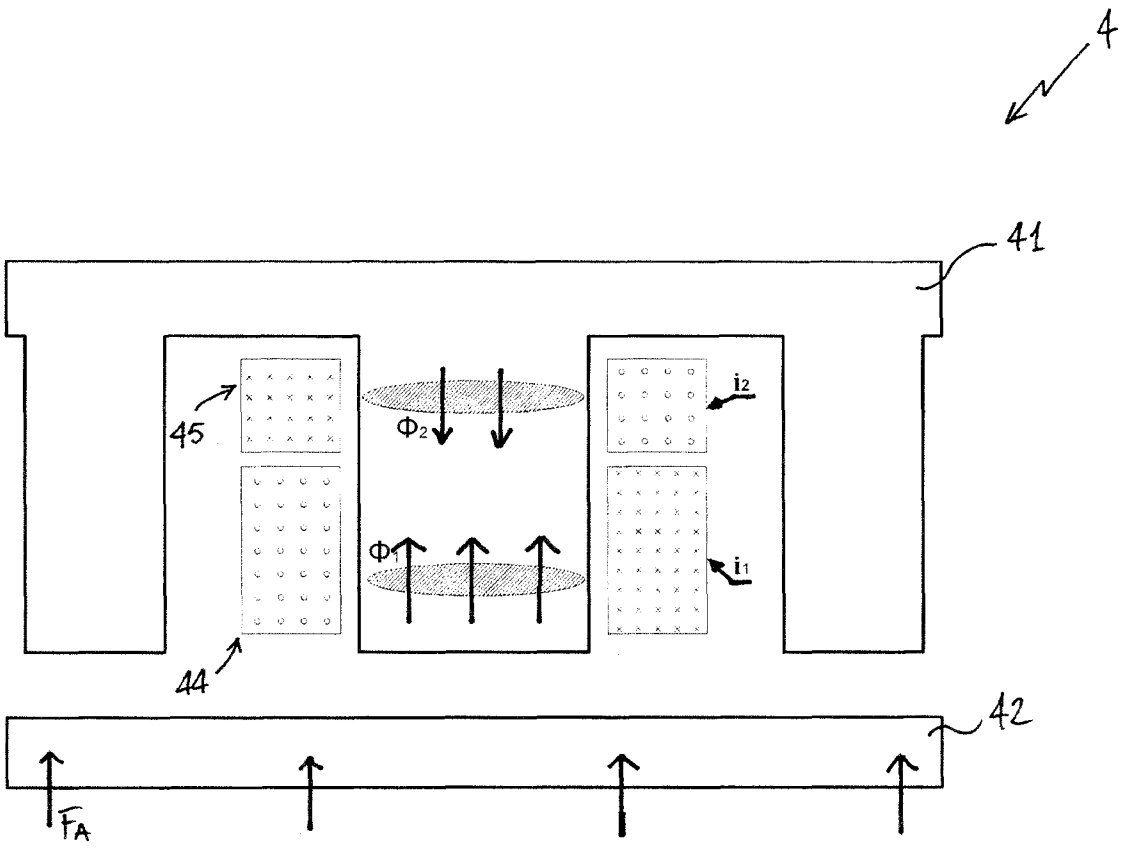
Figure 9:
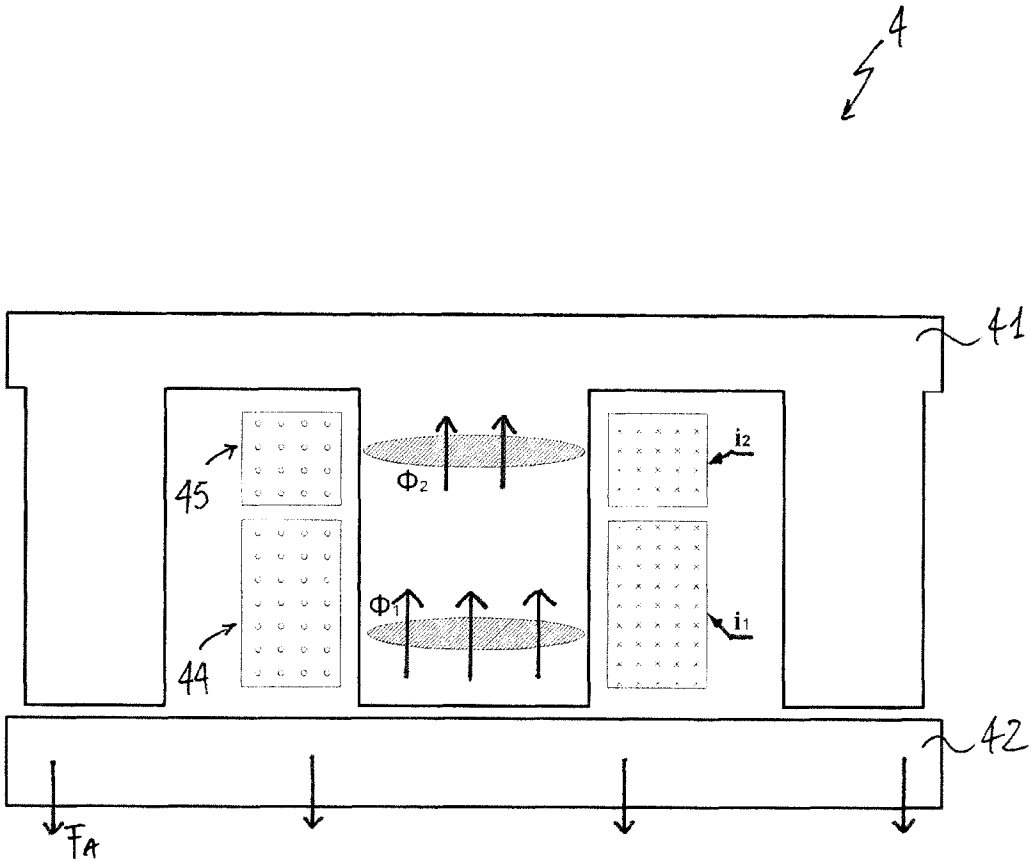
Figure 10:
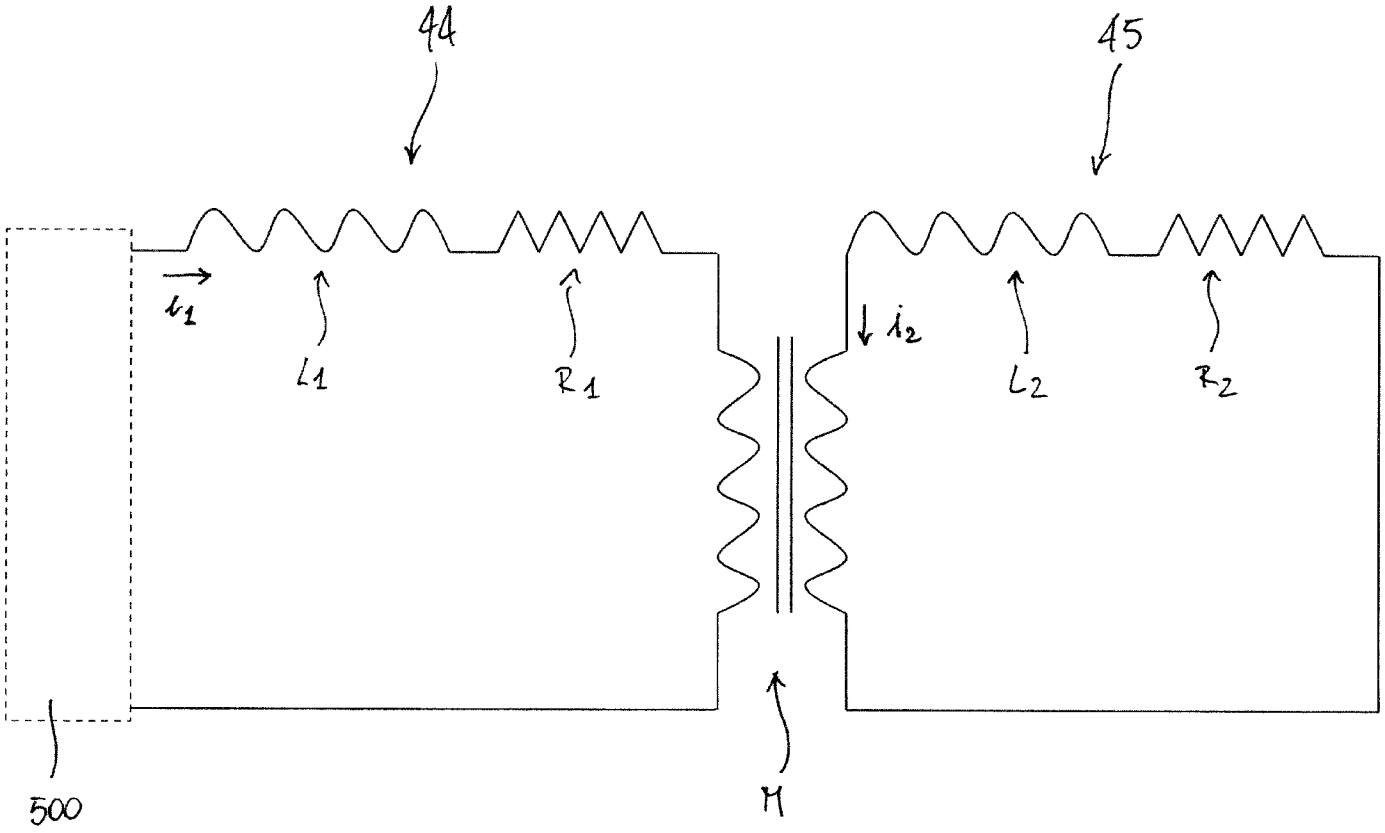
Figure 11:
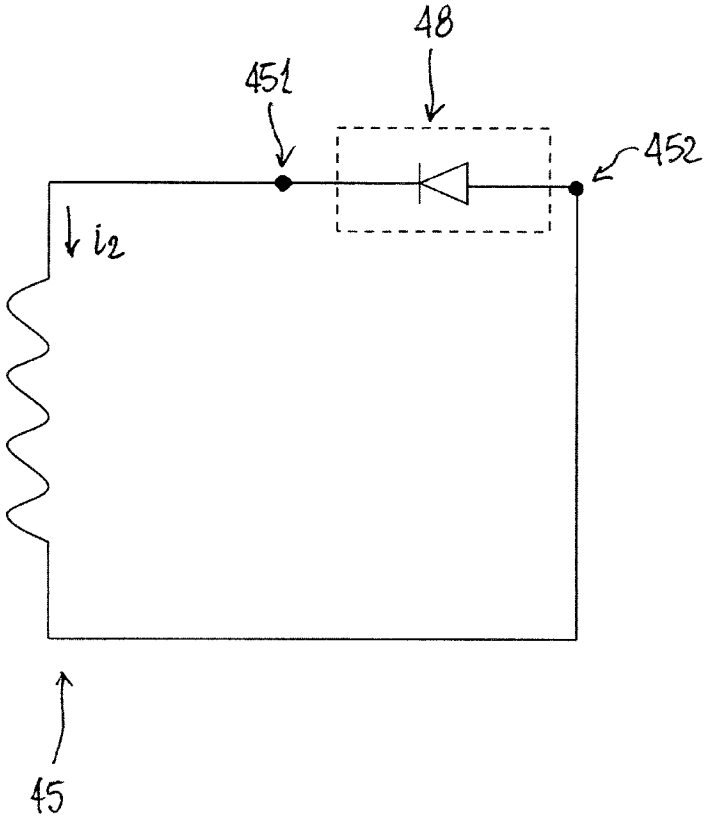
Figure 12:
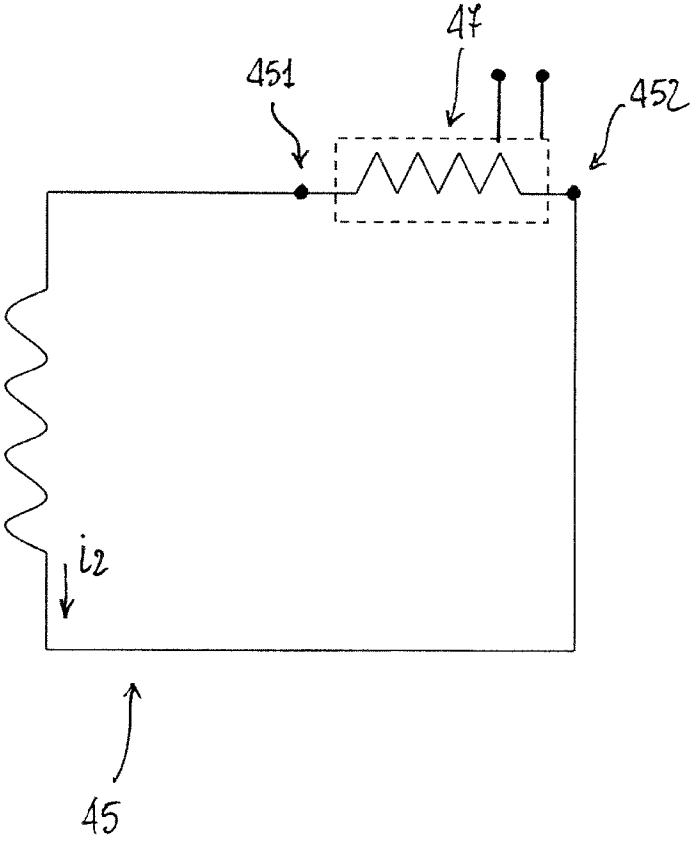

FIGS. 8-10 schematically show the operation of the contactor, according to the invention;

FIGS. 11-12 schematically show some parts of possible embodiments of the contactor, according to the invention.

With reference to the figures, the present invention relates to a contactor 1 for medium voltage (MV) electric systems.

The contactor 1 comprises a breaking section 11 and an actuation section 12, which respectively include the electric poles and the actuation components of the contactor.

Taking as a reference a normal installation position of the contactor, shown in the cited figures, the breaking section 11 is positioned on top of the actuation section 12.

The contactor 1 comprises an outer case 2 preferably made of electrically insulating material of known type (e.g. thermoplastic materials such as polyamide or polycarbonate or thermosetting materials such as polyester or epoxy resins and the like).

The outer case 2 is adapted to be fixed to a support (not shown) during the installation of the contactor 1.

The contactor 1 comprises one or more electric poles 3.

Preferably, the contactor 1 is of the multi-phase type, more particularly of the three-phase type, as shown in the cited figures.

Preferably, each electric pole 3 comprises a corresponding insulating housing 35, which is part of the outer case 2 at the breaking section 11 of this latter.

Preferably, each housing 35 is formed by an elongated (e.g. cylindrical) hollow body of electrically insulating material of known type.

Preferably, each housing 35 defines an internal volume, in which the components of the corresponding electric pole 3 are accommodated.

Advantageously, each electric pole 3 comprises a first pole terminal 36 and a second pole terminal 37, which may be mechanically fixed to the housing 35 by means of flanges.

Figure 1:
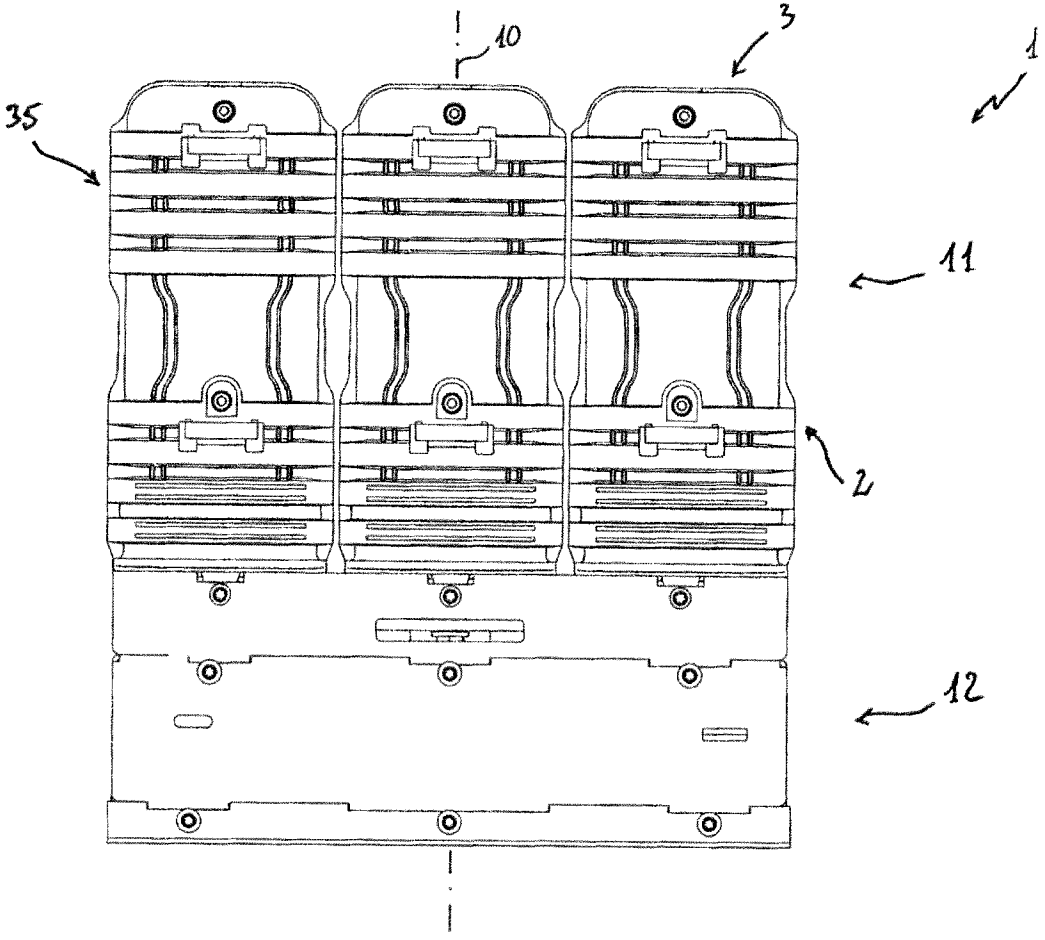
FIGS. 1-3 are schematic views of the contactor, according to the invention.
Figure 2:
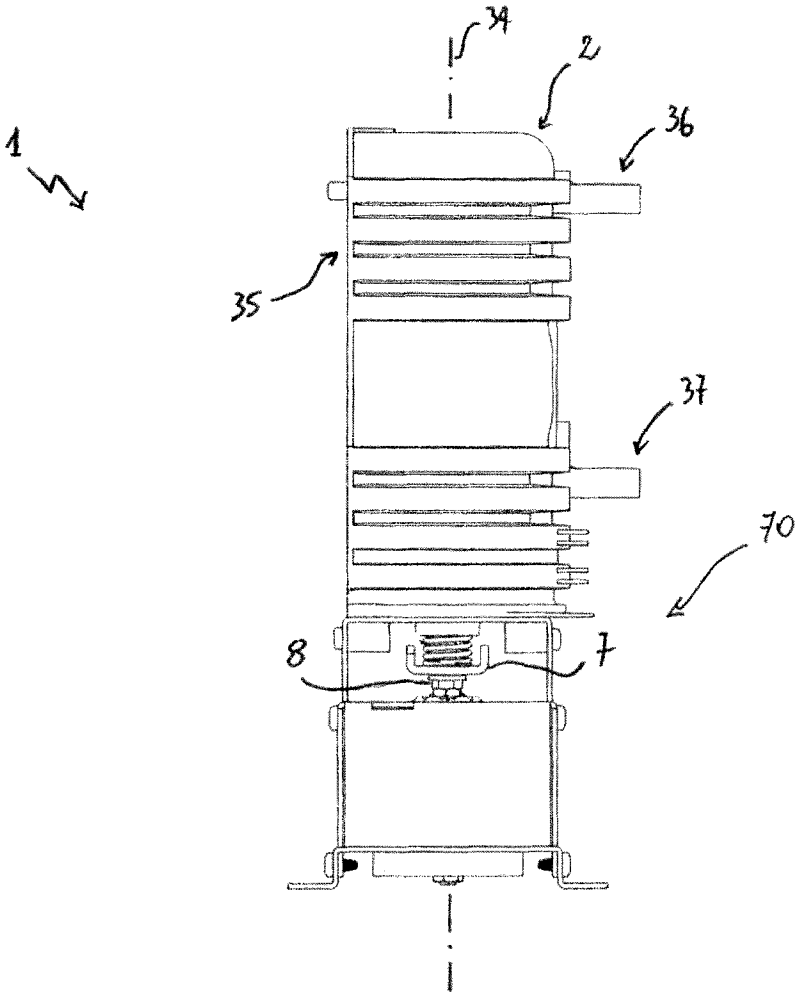
Figure 3:
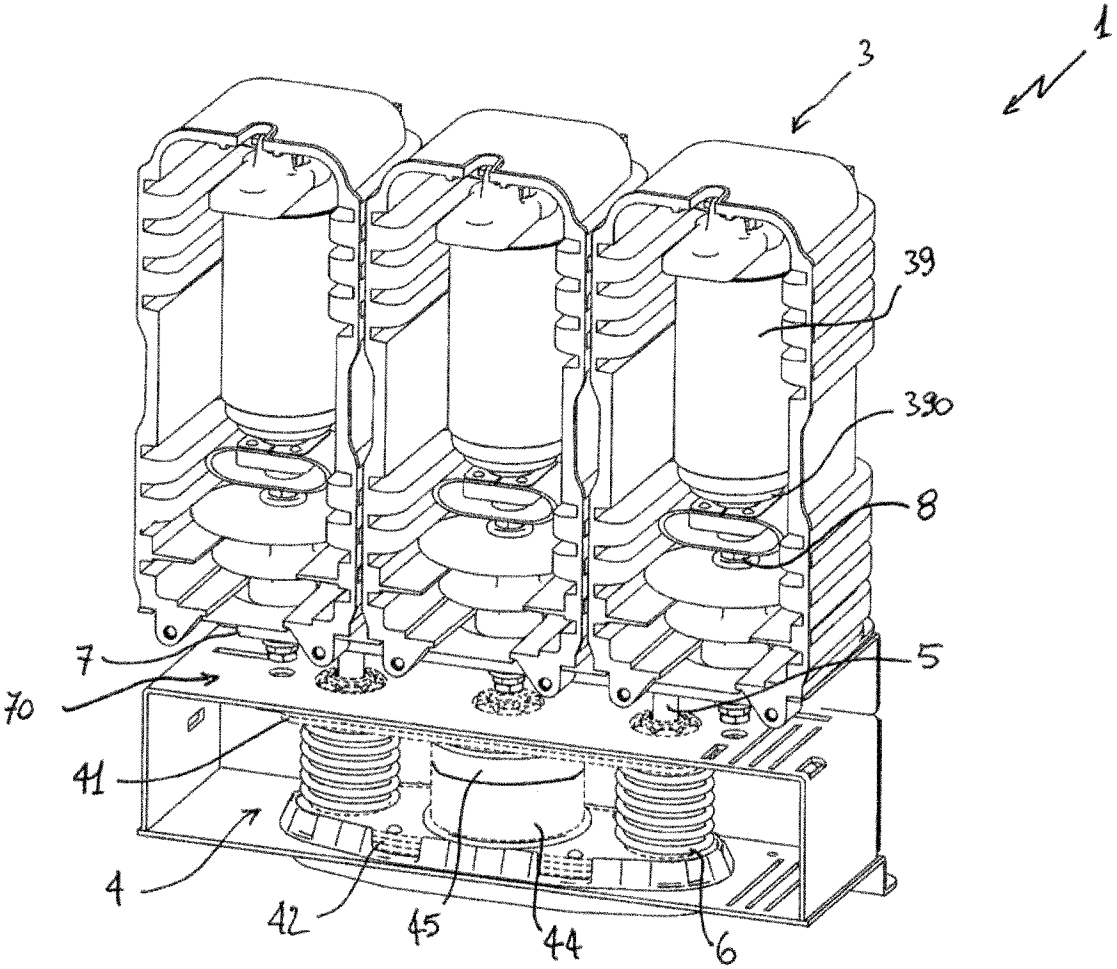

The pole terminals 36, 37 are adapted to be electrically connected with a corresponding electric conductor (e.g. a phase conductor) of an electric line (FIG. 2).

For each electric pole 3, the contactor 1 comprises a fixed contact 31 and a movable contact 32, which are electrically connected to the first and second pole terminals 36, 37 respectively. The movable contacts 32 are reversibly movable, along corresponding displacement axes 33 (e.g. forming the main longitudinal axes of the electric poles 3).

Figure 4:
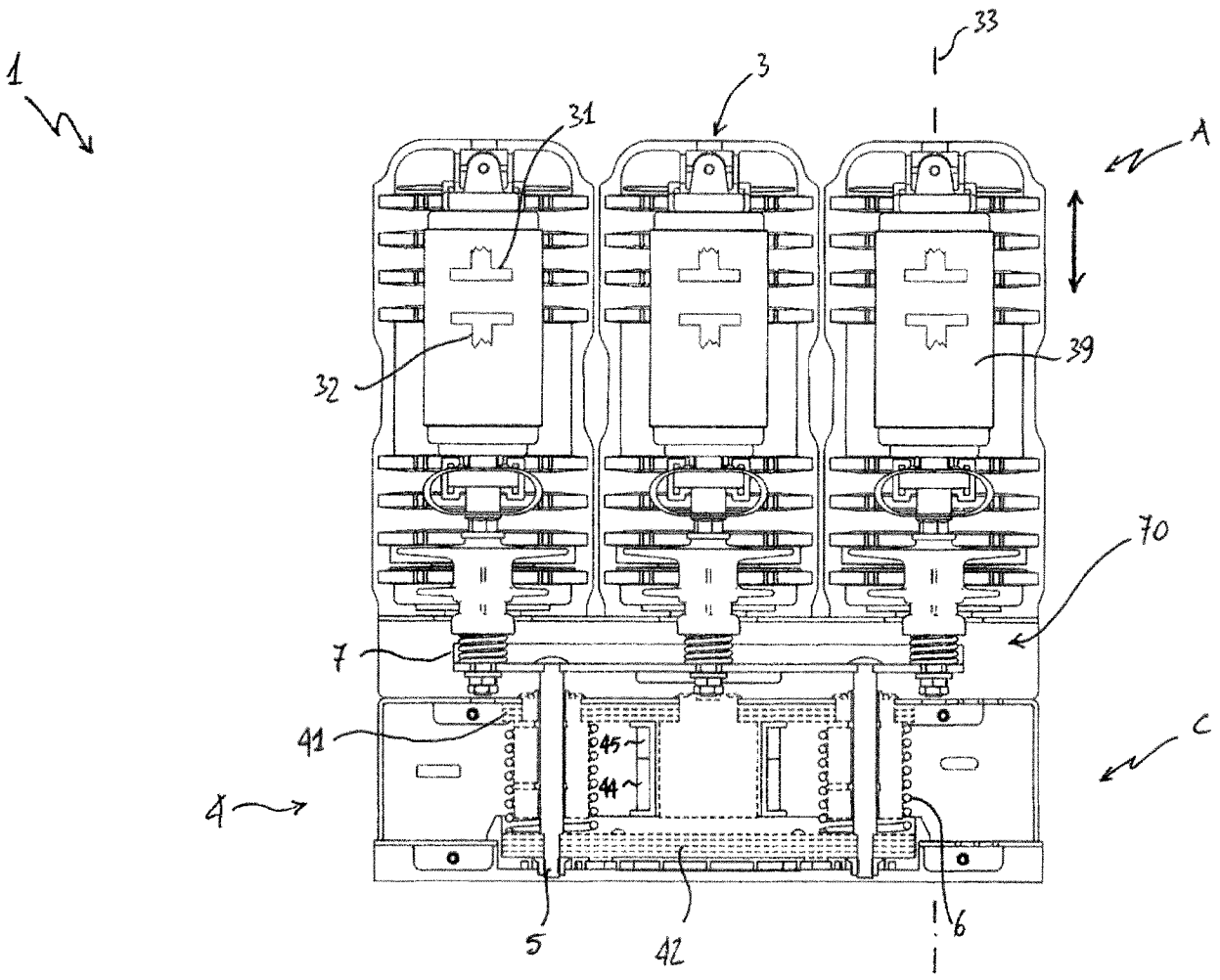
FIGS. 4-7 are schematic views showing the contactor, according to the invention, in different operating positions.
Figure 5:
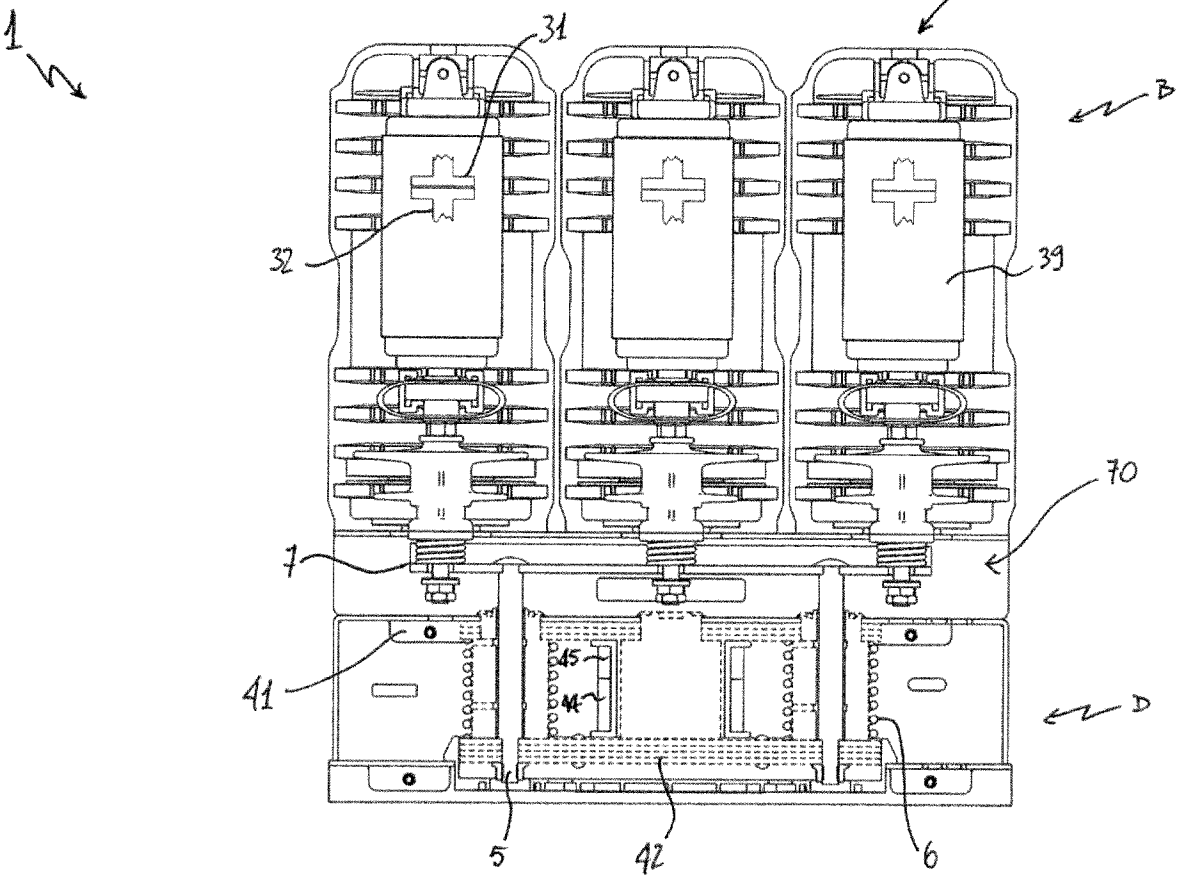
Figure 6:
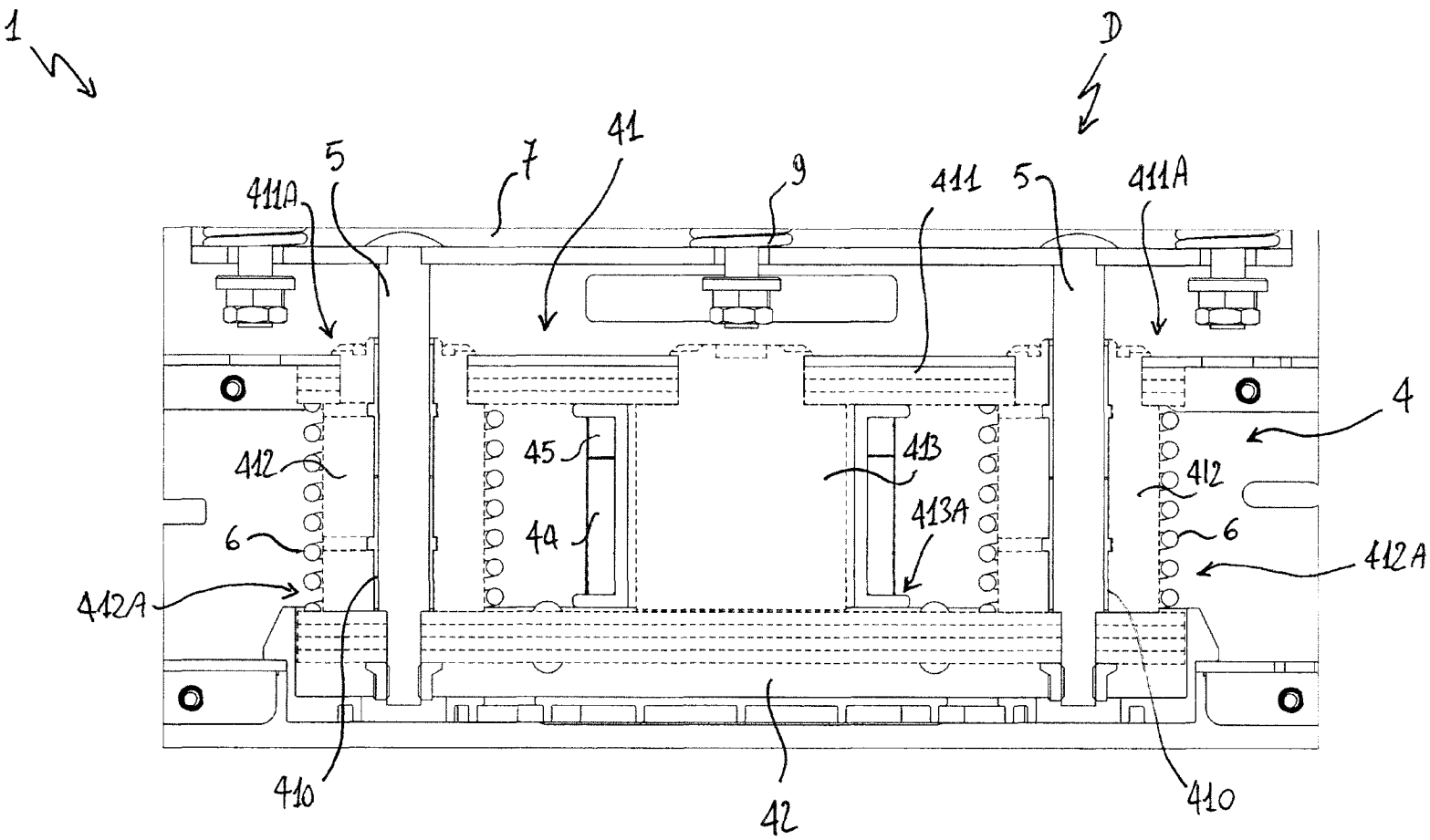
Figure 7:
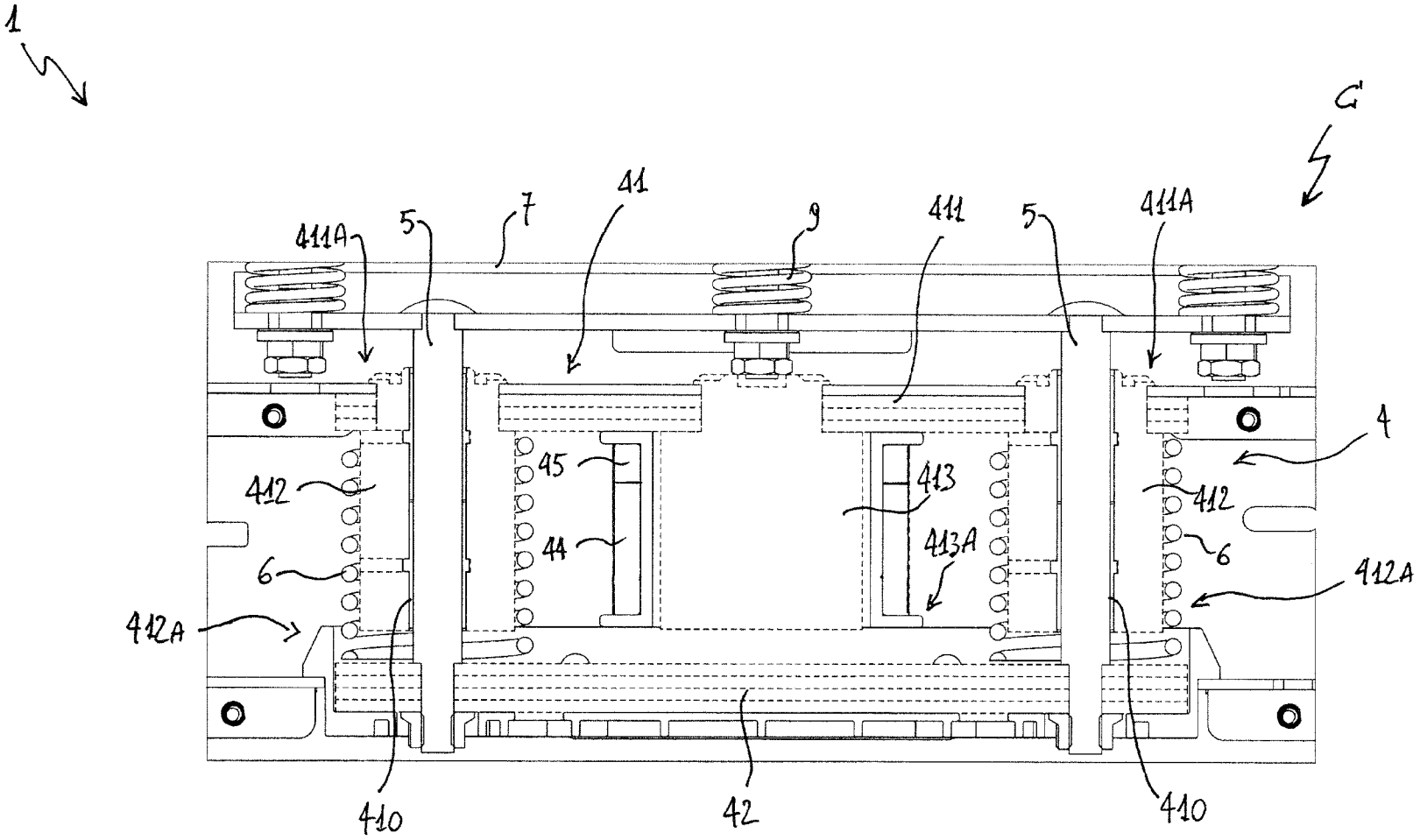

The movable contacts 32 are reversibly movable (see the corresponding bidirectional displacement arrow of FIG. 4) between a first position A (opening position), at which they are decoupled from the corresponding fixed contacts 31, and a second position B (closing position), at which they are coupled with the corresponding fixed contacts 31 (FIGS. 4-5).

The passage of the movable contacts 32 from the first position A to the second position B represents a closing manoeuver of the contactor 1 whereas the passage of the movable contacts 32 from the second position B to the first position A represents an opening manoeuver of the contactor 1.

When the movable contacts 32 are in the first position A—opening position—the contactor 1 is in an opening state, whereas, when the movable contacts 32 are in the second position B—closing position—the contactor 1 is in a closing state.

Preferably, the contactor 1 is of the vacuum type.

In this case, for each electric pole 3, the contactor 1 comprises a vacuum chamber 39.

In each vacuum chamber 39, a corresponding pair of movable and fixed contacts 31, 32 is placed and can be mutually coupled/decoupled.

Conventionally, each vacuum chamber 39 is partially defined by or operatively associated with a corresponding flexible sealing bellow 390 (which may be of known type) adapted to be reversibly deform during the movements of the corresponding movable contact 32.

The contactor 1 comprises an electromagnetic actuator 4.

The electromagnetic actuator 4 is advantageously part of the actuation section 12 of the contactor 1, at a distal position with respect to the movable contacts 32.

The electromagnetic actuator 4 is provided with a magnetic yoke 41-42 of ferromagnetic material of known type (e.g. Fe or Fe, Si, Ni, Co alloys), which forms a magnetic circuit.

In FIGS. 3-7, the parts made of ferromagnetic material of the magnetic yoke 41-42 are shown with dotted lines for illustrative purposes only.

The magnetic yoke of the electromagnetic actuator 4 comprises a fixed yoke member 41 and a movable yoke member 42.

The fixed yoke member 41 may be solidly fixed to outer casing 2 of the contactor by means of fixing means of known type.

The movable yoke member 42 is reversibly movable with respect to the fixed yoke member 41 between a third position C, at which it is decoupled from the fixed yoke member 41, and a fourth position D, at which it is coupled with the fixed yoke member 41 (FIGS. 4-7).

Advantageously, the third and fourth positions C, D of the movable yoke member 42 correspond respectively to the first and second positions A, B of the movable contacts 32.

In view of the above, it is evident that:

- the movable yoke member 42 passes from the third position C to the fourth position D to perform a closing manoeuver of the contactor;
- the movable yoke member 42 passes from the fourth position D to the third position C to perform an opening manoeuver of the contactor;
- when the movable yoke member 42 is in the third position C, the movable contacts 32 are decoupled from the corresponding fixed contacts 31 (opening position) and the contactor 1 is in an opening state;
- when the movable yoke member 42 is in the fourth position D, the movable contacts 32 are coupled with the corresponding fixed contacts 31 (closing position) and the contactor 1 is in a closing state.

The electromagnetic actuator 4 further comprises an excitation circuit assembly that comprises at least an excitation coil 44 wound around the magnetic yoke 41-42.

Preferably, said excitation circuit assembly comprises a single excitation coil 44 wound around the magnetic yoke 41-42.

In the following, the mentioned excitation circuit assembly will be described with reference to this case for the sake of simplicity.

However, in some embodiments, said excitation circuit assembly may comprise a plurality of excitation coils 44 wound around the magnetic yoke 41-42.

The excitation coil 44 of the mentioned excitation circuit assembly is arranged to form at least a conductive loop around the magnetic yoke 41-42.

To this aim, the excitation coil 44 may have one or more turns, according to the needs.

The excitation coil 44 is adapted to be electrically connected to an auxiliary electric power supply 500 (which may be of known type) to receive an excitation current $i_1$ from this latter. When the excitation coil 44 is fed by an excitation current $i_1$, an excitation magnetic flux Φ1 is generated, which circulates along the magnetic circuit formed by the fixed yoke member 41 and the movable yoke member 42.

The circulation of the excitation magnetic flux Φ1 along the magnetic circuit formed by the magnetic yoke 41-42, in fact, causes the generation of a primary magnetic force $F_1$ that makes the movable yoke member 42 to couple or remain coupled with the fixed yoke member 41 in order to close any possible airgap between these two ferromagnetic elements.

Thus, when the excitation coil 44 is fed by an excitation current $i_1$, the fixed yoke member 41 magnetically interacts with the movable yoke member 42, so that this latter moves from the third position C to the fourth position D, if the yoke members 41-42 are decoupled, or remains in the fourth position D, if the yoke members 41-42 are already coupled.

Besides, it is evidenced that the above-mentioned magnetic interaction between the fixed yoke member 41 and the movable yoke member 42 occurs irrespectively of the direction of the excitation current $i_1$, which may thus be positive or negative according to the needs.

In view of the above, it is evident that the electromagnetic actuator 4 is adapted to provide an actuation force (of magnetic type) to perform a closing manoeuvre (passage from the first position A to the second position B of the movable contacts 32) of the contactor or maintain the contactor in a closing state (movable contacts 32 in the second position B—closing position).

The contactor 1 comprises one or more opening springs 6 operatively coupled to the movable yoke member 42 to move this latter from the fourth position D to the third position C.

The opening springs 6 are adapted to store elastic energy when the movable yoke member 42 moves from the third position C to the fourth position D.

The opening springs 6 are adapted to release the stored elastic energy to move the movable yoke member 42 from the fourth position D to the third position C, when this latter is free to move away from the fourth position D (i.e. when the fixed yoke member 41 and the movable yoke member 42 stop magnetically interacting upon interruption of the excitation current $i_1$ feeding the excitation coil 44).

In view of the above, it is evident that the opening springs 6 are adapted to provide an actuation force (of mechanical type) to perform an opening manoeuvre (passage from the second position B to the first position A of the movable contacts 32) of the contactor.

The contactor 1 is thus of the mono-stable type.

Preferably, the opening springs 6 are advantageously part of the actuation section 12 of the contactor 1 and are preferably structurally integrated with the electromagnetic actuator 4, as shown in the cited figures.

Preferably, the opening springs 6 are operatively associated with the fixed yoke member 41 and the movable yoke member 42.

Preferably, the opening springs 6 are positioned between the fixed yoke member 41 and the movable yoke member 42 and have their ends operatively connected with the fixed yoke member 41 and the movable yoke member 42, according to a fixing arrangement of known type.

Preferably, the opening springs 6 are made of non-ferromagnetic material of known type (e.g. non-ferromagnetic stainless steel).

The contactor 1 comprises a kinematic chain 70 to connect operatively the movable yoke member 42 with the movable contacts 32.

In the following, a possible configuration for the kinematic chain is described with reference to the embodiments of the contactor 1 shown in the cited figures.

Other configurations of the kinematic chain 70 are however possible according to the needs.

Preferably, the kinematic chain 70 comprises a movable armature 7 reversibly movable along a displacement direction parallel to, and preferably co-planar with, the displacement axes 33 of the movable contacts 32.

Preferably, the movable armature 7 is formed by a beam of metallic material of known type (e.g. non-ferromagnetic steel or aluminium), which has a corresponding main longitudinal axis perpendicular to the displacement axes 33 of the movable contacts 32 and parallel to a displacement plane 34 of said movable contacts.

Preferably, the armature 7 is part of the actuation section 12 of the contactor 1, at a proximal position with respect to the movable contacts 32.

Preferably, the kinematic chain 70 comprises, for each electric pole 3 of the contactor, a first plunger 8 of non-ferromagnetic, electrically insulating material of known type (e.g. (e.g. thermoplastic materials such as polyamide or polycarbonate or thermosetting materials such as polyester or epoxy resins and the like).

Each plunger 8 is solidly connected with the movable armature 7 and with a corresponding movable contact 32 to transmit mechanical forces to the movable contacts 32, when the movable armature 7 is actuated.

Each plunger 8 may be solidly fixed to the movable armature 7 and the corresponding movable contact 32 by means of fixing means of known type.

Preferably, each plunger 8 extends along a corresponding main longitudinal axis parallel (and preferably co-planar) to or coinciding with the displacement axis 33 of a corresponding movable contact 32 of the contactor.

Preferably, each plunger 8 is at least partially accommodated in the internal volume defined by the housing 35 of a corresponding electric pole 3.

Preferably, the kinematic chain 70 comprises a plurality of second plungers 5 of non-ferromagnetic, electrically insulating material of known type (e.g. non-ferromagnetic stainless steel or other non-iron-based metallic materials).

Preferably, each plunger 5 is solidly connected with the movable yoke member 42 and the movable armature 7 to transmit mechanical forces to the movable armature 7 and consequently to the movable contacts 32, when the movable yoke member 42 is actuated.

Each plunger 5 may be solidly fixed to the movable armature 7 and the movable yoke portion 42 by means of fixing means of known type.

Preferably, each plunger 5 extends along a corresponding main longitudinal axis parallel (and preferably co-planar) to the displacement axes 33 of the movable contacts 32 of the contactor.

Preferably, the plungers 5 are advantageously part of the actuation section 12 of the contactor 1 and are preferably structurally integrated with the electromagnetic actuator 4.

Preferably, the contactor 1 comprises, for each electric pole 3, a contact spring 9 positioned between a corresponding fixed rest surface 91 and the movable armature 7.

The contact springs 9 may of known type and their structure and behaviour will not further described for the sake of brevity.

According to the invention, the electromagnetic actuator 4 comprises damping means adapted to reduce the actuation forces exerted on the movable yoke member 42, when this latter moves between the mentioned third and fourth positions C, D.

Such damping means comprise a damping circuit assembly 45, 47, 48 included in the electromagnetic actuator 4.

Such a damping circuit assembly comprises at least a damping coil 45 wound around said magnetic yoke 41-42.

Preferably, said damping circuit assembly comprises a single damping coil 45 wound around the magnetic yoke 41-42.

In the following, the mentioned damping circuit assembly will be described with reference to this case for the sake of simplicity.

However, in some embodiments, said damping circuit assembly may comprise a plurality of damping coils 45 wound around the magnetic yoke 41-42.

The damping coil 45 of the mentioned damping circuit assembly is arranged to form at least conductive loop around said magnetic yoke 41-42.

To this aim, the damping coil 45 may have one or more turns, according to the needs.

The conductive loop formed by the damping coil 4 is arranged so as to be at least partially enchained with the excitation magnetic flux Φ1 generated by the excitation current $i_1$ flowing along the excitation coil 44, when this latter is fed by the auxiliary electric power supply 500.

In this way, according to the well-known physical laws dealing with electromagnetic induction phenomena, any transient of the excitation magnetic flux Φ1 enchained with the damping coil 45 (and consequently of the excitation current $i_1$) causes a secondary current $i_2$ to circulate along the damping coil 45.

The flow direction of the secondary current $i_2$ depends on the sign of the derivative of the excitation magnetic flux Φ1 (and consequently on the derivative of the excitation current $i_1$).

In turn, the secondary current $i_2$ generates a secondary magnetic flux Φ2, which may have a same direction or an opposite direction with respect to the excitation magnetic flux Φ11 depending on the flow direction of the secondary current $i_2$.

The secondary magnetic flux Φ2 generates a secondary magnetic force $F_2$ that is exerted on the movable yoke member 42.

As it will be better described in the following, a particular characteristic of the contactor 1 consist in that, during the execution of a closing manoeuvre or an opening manoeuvre, such a secondary magnetic force $F_2$ is always directed in such a way to cause a reduction of the overall actuation force exerted on the movable yoke member 42.

In this way, the movable contacts 32 can move at an optimal speed, during the execution of a closing manoeuvre or an opening manoeuvre of the contactor, even if they are actuated with an actuation force higher than the necessary to perform said manoeuvers.

The electric behavior of the excitation coil 44 and of the damping coil 45 can be represented as in FIG. 10.

The excitation coil 44 may be represented as a first circuit series of a first equivalent inductance $L_1$ and of a first equivalent resistance $R_1$, the values of which depend on the physical arrangement of the excitation coil 44.

Similarly, the excitation coil 45 may be represented as a second circuit series of a second equivalent inductance $L_2$ and of a second equivalent resistance $R_2$, the values of which depend on the physical arrangement of the damping coil 45.

A first and second circuit series mutually interact due to the presence of a mutual inductance M between the mentioned series circuits. The value of said mutual inductance depends on the physical arrangement of the excitation coil 44 and damping coil 45.

The operation of the contactor 1 is now described in more details with reference to this embodiment.

Opening State of the Contactor

When the contactor 1 is in an opening state, the movable contacts 32 are in the first position A (opening position, i.e. decoupled from the fixed contacts 31) and the movable yoke member 42 is in the third position C, i.e. decoupled from the fixed yoke member 41 and separated from this latter by an airgap.

The opening springs 6 are not compressed (with respect to an installation biasing state).

The coil 44 is not fed by the electric power source 500 and no magnetic flux is generated.

The opening state of the contactor 1 is stably maintained by the opening springs 6, which prevent any movement of the movable yoke member 42 away from the third position C.

Closing Manoeuvre of the Contactor

To perform a closing manoeuvre of the contactor 1, the electric power supply 500 feeds the excitation coil 44 by providing a current pulse having a given launch value and launch duration.

An excitation current $i_1$, which has an increase transient (positive derivative), which substantially follows a time constant $\tau_1$ H $L_1/R_1$ flows along the excitation coil 44.

The excitation current $i_1$ generates an excitation magnetic flux Φ1, which has in turn an increase transient (positive derivative) in accordance with the excitation current $i_1$.

A transient of the excitation magnetic flux Φ1 enchained with the damping coil 45 causes a secondary current $i_2$ to circulate along the damping coil 45.

The secondary current $i_2$ has an opposite direction with respect to the excitation current $i_1$ and generates a secondary magnetic flux Φ2, which has an opposite direction with respect to the excitation magnetic flux Φ1 (FIG. 8).

The overall excitation magnetic flow $\Phi_{TOT}$ circulating along the magnetic circuit formed by the magnetic yoke 41-42 is substantially given by the following relation: $\Phi_{TOT} \approx (\Phi 1 - \Phi 2$.

As the fixed yoke member 41 and the movable yoke member 42 are initially separated by an airgap, an overall magnetic force $F_{MTOT}$ is exerted on the movable yoke member 42 to close such an air gap.

Such a magnetic force is substantially given by the following relation: $F_{MTOT} \approx F_1 - F_2$, where $F_1$, $F_2$ are the primary and secondary magnetic forces generated by the magnetic fluxes 11, (2, respectively.

As it is evident, the overall magnetic force $F_{MTOT}$ is decreased with respect to the case in which the damping coil 45 is not present.

The overall magnetic force $F_{MTOT}$ is sufficiently strong to move the movable yoke member 42 towards the fourth position D against an opposition force $F_S$ exerted by the opening springs 6.

The overall actuation force $F_A$ exerted on the movable yoke member 42, during the movement of this latter, is substantially given by the following relation: $F_A \approx F_{MTOT} - F_S$, where $F_{MTOT}$ is the overall magnetic force exerted by the electromagnetic actuator 4 and $F_S$ is the overall mechanical force exerted by the opening springs 6.

As it is evident, since the overall magnetic force $F_{MTOT}$ is decreased, the actuation force $F_A$ exerted on the movable yoke member is decreased with respect to the case in which the damping coil 45 is not present.

During the movement of the movable yoke member 42 towards the fourth position D, the opening springs 6 are compressed, thereby storing elastic energy and the movable yoke member 42 transmits mechanical forces to the movable armature 7 through the second plungers 5.

The movable armature 7 moves and transmits mechanical forces to the movable contacts 32 through the first plungers 8.

The movable contacts 32 thus move towards the second position B.

As soon as the movable contacts reach the second position B and couple with the respective fixed contacts 31, the closing maneuver is completed and the contactor 1 is in a closing state.

Closing State of the Contactor

When the contactor 1 is a closing state, the movable contacts 32 are in the second position B (closing position, i.e. coupled with the fixed contacts 31) and the movable yoke member 42 is in the fourth position D, i.e. coupled with the fixed yoke member 41.

The opening springs 6 are compressed (with respect to their biasing state).

The excitation coil 44 is still fed by an excitation current $i_1$, which has a constant holding value.

The excitation current $i_1$ generates a constant excitation magnetic flux Φ1.

As it is not subject to transient, the excitation magnetic flux Φ1 enchained with the damping coil 45 does not cause a secondary current $i_2$ to circulate along the damping coil 45.

The overall excitation magnetic flow $\Phi_{TOT}$ circulating along the magnetic circuit formed by the magnetic yoke 41-42 is substantially given by the following relation: $\Phi_{TOT} \approx \Phi 1$.

An overall magnetic force $F_{MTOT}$ is exerted on the movable yoke member 42 to avoid the formation of an air gap between the fixed yoke member 41 and the movable yoke member 42.

Such a magnetic force is substantially given by the following relation: $F_{MTOT} \approx F_1$, where $F_1$ is the primary magnetic force generated by the magnetic flux Φ1.

The overall magnetic force $F_{MTOT}$ is sufficiently strong to maintain the movable yoke member 42 coupled with the fixed yoke member 41 against the opposition force $F_S$ exerted by the opening springs 6.

The overall actuation force $F_A$ exerted on the movable yoke member 42, during the movement of this latter, is substantially given by the following relation: $F_A \approx F_{MTOT} - F_S \approx F_1 - F_S$, where $F_{MTOT}$ is the overall magnetic force exerted by the electromagnetic actuator 4, $F_1$ is the primary magnetic force generated by the magnetic flux Φ1 and $F_S$ is the overall mechanical force exerted by the opening springs 6.

As it is evident, the actuation force $F_A$ exerted on the movable yoke member is not changed with respect to the case in which the damping coil 45 is not present.

The closing state of the contactor is stably maintained by continuously feeding the excitation coil 44.

Opening Manoeuvre of the Contactor

To perform an opening manoeuvre of the contactor 1, the electric power supply 500 stops feeding the excitation coil 44.

The excitation current $i_1$ flowing along the excitation coil 44 is subject to a decrease transient (negative derivative) substantially following the mentioned time constant $\tau_1$.

The excitation current $i_1$ generates an excitation magnetic flux Φ1, which has in turn a decrease transient (negative derivative) in accordance with the excitation current $i_1$.

A transient of the excitation magnetic flux Φ1 enchained with the damping coil 45 causes a secondary current $i_2$ to circulate along the damping coil 45.

The secondary current $i_2$ has a same direction with respect to the excitation current $i_1$ and generates a secondary magnetic flux Φ2, which has a same direction with respect to the excitation magnetic flux Φ1 (FIG. 9).

The overall excitation magnetic flow $\Phi_{TOT}$ circulating along the magnetic circuit formed by the magnetic yoke 41-42 is substantially given by the following relation: $\Phi_{TOT} \approx \Phi 1 + \Phi 2$.

An overall magnetic force $F_{MTOT}$ is exerted on the movable yoke member 42 to avoid the formation of an air gap between the fixed yoke member 41 and the movable yoke member 42.

Such a magnetic force is substantially given by the following relation: $F_{MTOT} \approx F_1 + F_2$, where $F_1$, $F_2$ are the magnetic forces generated by the magnetic fluxes Φ1, Φ2, respectively.

As it is evident, the magnetic force $F_{MTOT}$ is increased with respect to the case in which the damping coil 45 is not present.

The overall actuation force $F_A$ exerted on the movable yoke member 42, during the movement of this latter, is substantially given by the following relation: $F_A = Fs - F_{MTOT}$, where $F_{MTOT}$ is the overall magnetic force exerted by the electromagnetic actuator 4 and $F_S$ is the overall mechanical force exerted by the opening springs 6.

As it is evident, as the overall magnetic force $F_{MTOT}$ is increased, the actuation force $F_A$ exerted on the movable yoke member is decreased with respect to the case in which the damping coil 45 is not present.

The magnetic force $F_{MTOT}$ exerted by the electromagnetic actuator is no more sufficient to maintain the movable yoke member 42 coupled with the fixed yoke member 41.

The movable yoke member 42 thus moves away from the fixed yoke member towards the third position C.

The opening springs 6 can release the stored elastic energy.

During its movement, the movable yoke member 42 transmits mechanical forces to the movable armature 7 through the second plungers 5.

The movable armature 7 moves and transmits mechanical forces to the movable contacts 32 through the first plungers 8.

The movable contacts 32 thus move towards the first position A.

As soon as the movable contacts reach the first position A, the opening maneuver is completed and the contactor 1 is in an opening state.

According to an embodiment of the invention, the mentioned damping circuit assembly comprises a sensing circuit 47 operatively associated with the damping coil 45 (FIG. 12).

The sensing circuit 47 is advantageously configured to sense the secondary current $i_2$ circulating along the damping coil 45.

Such a solution may be quite advantageous as it allows collecting useful information about the actual operating conditions of the contactor.

As an example, the waveform of the secondary current $i_2$ can be monitored during the execution of the opening/closing manoeuvers of the contactor. Changes in the waveform of the secondary current i2 may be indicative of possible incoming faults in the contactor.

As a further example, information on the secondary current $i_2$ may be used to control the excitation current $i_1$ in order to properly tune the movement of the movable contacts 32.

Finally, information on the secondary current $i_2$ may be used to obtain information on the actual behaviour of the excitation current $i_1$. In this case, the assembly formed by the damping coil 45 and the damping circuitry 47 operates as a sensor for detecting the excitation current $i_1$. Preferably, the sensing circuit 47 comprises a shunt circuit electrically connected in series with the terminals 451, 452 of the damping coil 45, as shown in FIG. 12.

As an alternative, the sensing circuit 47 may comprise a proximity sensor (e.g. a Hall effect sensor) or a current transformer operatively coupled to a branch of the damping coil 45.

The arrangement of the sensing circuit 47 in the mentioned damping circuit assembly does not substantially modify the behavior of the contactor that substantially operates as described above.

According to an embodiment of the invention, the mentioned damping circuit assembly comprises a blocking circuit 48 operatively associated with the damping coil 45 (FIG. 11).

The blocking circuit 48 is advantageously configured to allow a current $i_2$ to circulate along the damping coil 45 or to prevent the secondary current $i_2$ from circulating along said damping coil depending on the direction of said secondary current.

Preferably, the blocking circuit 48 is configured to allow the secondary current $i_2$ to circulate along the damping coil 45, when the movable yoke member 42 moves from the fourth position D to the third position C, i.e. during an opening manoeuver of the contactor, and prevent the secondary current $i_2$ to circulate along the damping coil 45, when the movable yoke member 42 moves from the third position C to the fourth position D, i.e. during a closing manoeuver of the contactor.

The arrangement of the sensing circuit 47 in the mentioned damping circuit assembly has noticeable consequences on the behavior of the contactor.

Opening Manoeuvre of the Contactor

During an opening manoeuver of the contactor, a reduction the actuation force $F_A$ exerted on the movable yoke member 42 occurs as described above, since the secondary current $i_2$ is allowed to circulate along the damping coil 45 by the blocking circuit 48.

Closing Manoeuvre of the Contactor

During a closing manoeuver of the contactor, no reduction of the actuation force $F_A$ exerted on the movable yoke member 42 occurs as the the secondary current $i_2$, which in principle would be generated by a transient of the excitation magnetic flux Φ1, is not allowed to circulate. In other words, the contactor behaves as the damping coil 45 is not present.

The solution described above has the advantage of simplifying the operation of the contactor without intervening on the behavior of this latter during the closing manoeuvers.

In practice, the mentioned damping circuit assembly is arranged to intervene to reduce the actuation force $F_A$ exerted on the movable yoke member 42 only during the most critical manoeuvers of the contactor (opening manoeuvers).

Preferably, the blocking circuit 48 comprises a diode circuit electrically connected in series with the terminals 451, 452 of the damping coil 45, as shown in FIG. 11.

The diode circuit 48 is advantageously arranged in such a way to allow the circulation of a current according to a direction corresponding to the direction taken by the secondary current $i_2$ during an opening manoeuver of the contactor (FIGS. 9, 11).

Obviously, the blocking circuit 48 may be configured to allow the secondary current $i_2$ to circulate along the damping coil 45, when the movable yoke member 42 moves from the third position C to the fourth position D, i.e. during a closing manoeuver of the contactor, and prevent the secondary current $i_2$ to circulate along the damping coil 45, when the movable yoke member 42 moves from the fourth position D to the third position C, i.e. during an opening manoeuver of the contactor.

In this case, a reduction of the actuation force $F_A$ exerted on the movable yoke member 42 occurs only during the closing manoeuvers of the contactor whereas, during the opening manoeuvers of the contactor, no reduction of the actuation force $F_A$ exerted on the movable yoke member 42 occurs.

Of course, in this case, the diode circuit 48 is advantageously arranged according to an opposite configuration with respect to the one shown in FIG. 11.

According to some embodiments of the invention, the mentioned damping circuit assembly may comprise both the sensing circuit 47 and the blocking circuit 48 described above.

In the cited figures (FIGS. 6-7), an embodiment of the contactor is shown, in which a highly compact structure and a high level of integration among the parts, in particular among the kinematic chain 70, the electromagnetic actuator 4 and the opening springs 6, is obtained.

According to such an embodiment, the fixed yoke member 41 has an E-shaped structure, which is provided with a plurality of limb portions 412, 413 extending distally with respect to the movable contacts 32 of the contactor.

The fixed yoke member 41 comprises a main portion 411 in a proximal position with respect to the movable contacts 32.

Conveniently, the main portion 411 is formed by a shaped beam of ferromagnetic material, which has a main longitudinal axis perpendicular to the displacement axes 33 of the second movable contacts 32 and parallel to the displacement plane 34 of said movable contacts.

The main portion 411 of the fixed yoke member 41 may be formed by a shaped packed beam structure including multiple overlapped strips of ferromagnetic material of known type (e.g. having thickness of 2-4 mm) and, possibly, one or more strips of electrically insulating material of known type.

Preferably, the main portion 411 has opposite free ends 411A, which are fixed to the outer casing 2 by means of suitable fixing means of known type.

According to this embodiment of the invention, the fixed yoke member 41 comprises a pair of lateral limb portions 412, each positioned at a corresponding end 411A of the main portion 411 and symmetrically arranged (i.e. equally spaced) with respect to a main symmetry plane 10 of the contactor.

The limb portions 412 protrude from the main portion 411 towards the movable yoke member 42, which is distally positioned with respect to the movable contacts 32.

Each of the limb portions 412 has a corresponding free end 412A in a distal position with respect to the movable contacts 32.

The free ends 412A of the lateral limb portions 412 are adapted to couple with the movable yoke member 42, when this latter reaches the fourth position D.

According to this embodiment of the invention, the fixed yoke member 41 further comprises an intermediate limb portion 413 positioned between the lateral limb portions 412.

The limb portion 413 protrudes from the main portion 411 towards the movable yoke member 42.

Preferably, the limb portion 413 is positioned along the main symmetry plane 10 of the contactor.

The limb portion 413 has a corresponding free end 413A in a distal position with respect to the movable contacts 32.

Preferably, the excitation coil assembly 44 is arranged at the intermediate limb portion 413 of the fixed yoke member 41. More particularly, the excitation coil 44 is wound around the intermediate limb portion 413 of the fixed yoke member 41.

Preferably, the excitation coil assembly 45, 47, 48 is arranged at the intermediate limb portion 413 of the fixed yoke member 41. More particularly, the damping coil 45 is wound around the intermediate limb portion 413 of the fixed yoke member 41.

In the embodiment shown in the cited figures, both the excitation coil 44 and the damping coil 45 are wound around the intermediate limb portion 413 of the fixed yoke member 41.

Preferably, the fixed yoke member 41 comprises a pair of through holes 410, which are symmetrically positioned (i.e. equally spaced) with respect to the main symmetry plane 10 of the contactor and are coaxial with a corresponding lateral limb portion 412 thereof.

In practice, each through hole 410 passes through the whole length of the respective lateral limb portion 412 and the whole thickness of the main portion 411 at a corresponding end 411A of this latter.

Preferably, each plunger 5 of the kinematic chain 70 is inserted in a corresponding through hole 410 and passes through a corresponding limb portion 412 and the main portion 411 of the fixed yoke member 41.

Preferably, a pair of opening springs 6 is arranged, each of which is coupled with the main portion 411 of the fixed yoke member 41 and with the movable yoke member 42.

Preferably, each opening spring 6 is positioned coaxially with a corresponding limb portion 412 of the fixed yoke member 41 and outwardly surrounds said corresponding limb portion.

According to this embodiment of the invention, the movable yoke member 42 is formed by a shaped beam of ferromagnetic material of known type, which has a main longitudinal axis perpendicular to the displacement axes 33 of the second movable contacts 32 and parallel to the displacement plane 34 of said movable contacts.

The movable yoke member 42 may be formed by a shaped packed beam structure including multiple overlapped strips of ferromagnetic material of known type (e.g. having thickness of 2-4 mm) and, possibly, one or more strips of electrically insulating material of known type.

The contactor 1, according to the invention, provides remarkable advantages with respect to the known apparatuses of the state of the art.

The contactor 1 is characterised by high levels of reliability for the intended applications.

The arrangement of the damping circuit assembly 45, 46, 47 allows avoiding or remarkably limiting over-travelling or back-travelling movements of the movable contacts 32, particularly during the opening manoeuvers of the contactor.

The damping circuit assembly 45, 46, 47 allows optimally tuning the actuation force actually exerted on the movable contacts 32, thereby reducing the instantaneous peaks of speed of these latter.

This allows prolonging the operating life of important components of the contactors, such as the sealing bellows 390.

In addition, it allows avoiding the use of mechanical dampers or the arrangement of complicated electronic arrangements to control the excitation current $i_1$ and, consequently, the magnetic force exerted by the electromagnetic actuator 4.

In the contactor 1, the electromagnetic actuator 4, the opening springs 6 and the kinematic chain 70 are arranged with high levels of structural integration, which allows obtaining a very compact and robust actuation section with relevant benefits in terms of size optimization of the overall structure of the contactor.

The contactor 1 is of relatively easy and cheap industrial production and installation on the field.

The invention claimed is:

1. A contactor for medium voltage electric systems comprising:

one or more electric poles;

for each electric pole, a fixed contact and a corresponding movable contact reversibly movable between a first position, at which said movable contact is decoupled from said fixed contact, and a second position, at which said movable contact is coupled with said fixed contact;

an electromagnetic actuator comprising a magnetic yoke having a fixed yoke member and a movable yoke member, said movable yoke member being reversibly movable between a third position corresponding to the first position of said movable contact, at which said movable yoke member is decoupled from said fixed yoke member, and a fourth position corresponding to the second position of said movable contact, at which said movable yoke member is coupled with said fixed yoke member, said electromagnetic actuator further comprising an excitation circuit assembly comprising at least an excitation coil wound around said magnetic yoke and electrically connected with an auxiliary electric power supply, said excitation coil being fed with an excitation current to generate an excitation magnetic flux to move said movable yoke member from said third position to said fourth position or to maintain said movable yoke member in said fourth position;

wherein said fixed yoke member comprises:

a main portion in a proximal position with respect to said movable contact and shaped as a beam having a main longitudinal axis perpendicular to displacement axes of said movable contact and parallel to a displacement plane of said movable contacts;

a pair of lateral limb portions, each positioned at a corresponding end of said main portion and protruding from said main portion towards said movable yoke member, each of said lateral limb portions having a corresponding free end in a distal position with respect to said movable contacts, the free ends of said lateral limb portions being decoupled from said movable yoke member, when said movable yoke member in said third position, and being coupled with said movable yoke member, when said movable yoke member in said fourth position;

an intermediate limb portion positioned between said lateral limb portions and protruding from said main portion towards said movable yoke member, said intermediate limb portion having a corresponding free end in a distal position with respect to said main portion one or more opening springs operatively coupled with said movable yoke member to move said movable yoke member from said fourth position to said third position;

a kinematic chain to operatively connect said movable yoke member with said movable contacts;

said electromagnetic actuator comprises a damping circuit assembly comprising at least a damping coil arranged to form a conductive loop at least partially enchained with the excitation magnetic flux generated by the excitation current flowing along said excitation coil, when said auxiliary electric power supply provides said excitation current to said excitation coil, in such a way that a secondary current circulates along said damping coil when said excitation magnetic flux is subject to a transient, wherein the damping circuit is configured with the conductive loop being a closed current path throughout at least one of: (a) movement of the yoke member from the third position to the fourth position thereby reducing closing force on the movable yoke member, and (b) movement of the yoke member from the fourth position to the third position thereby reducing opening force on the movable yoke member.

2. The contactor, according to claim 1, wherein said damping circuit assembly comprises a sensing circuit operatively associated with said damping coil to sense said secondary current.

3. The contactor, according to claim 1, wherein said damping circuit assembly comprises a blocking circuit operatively associated with said damping coil to allow or prevent a circulation of said secondary current along said damping coil depending on the direction of said secondary current.

4. The contactor, according to claim 3, wherein said blocking circuit is configured to allow said secondary current to circulate along said damping coil, when said movable yoke member moves from said fourth position to said third position and is configured to prevent said secondary current from circulating along said damping coil, when said movable yoke member moves from said third position to said fourth position.

5. The contactor, according to claim 1, wherein said excitation coil is wound around said fixed yoke member.

6. The contactor, according to claim 1, wherein said damping coil is wound around said fixed yoke member.

7. The contactor, according to claim 1, wherein said movable yoke member is shaped as a beam having a main longitudinal axis perpendicular to the displacement axes of said second movable contacts and parallel to the displacement plane of said movable contacts.

8. The contactor, according to claim 5, wherein said excitation coil is wound around an intermediate limb portion of said fixed yoke member.

9. The contactor, according to claim 6, wherein said damping coil is wound around an intermediate limb portion of said fixed yoke member.

10. The contactor, according to claim 1, wherein it comprises, for each electric pole, a vacuum chamber, in which a corresponding fixed contact and a corresponding movable contact are placed to be mutually coupled or decoupled.

11. The contactor, according to claim 1, wherein it comprises a plurality of electric poles.

12. The contactor according to claim 2, wherein said damping circuit assembly comprises a blocking circuit operatively associated with said damping coil to allow or prevent a circulation of said secondary current along said damping coil depending on the direction of said secondary current.

13. The contactor according to claim 12, wherein said blocking circuit is configured to allow said secondary current to circulate along said damping coil, when said movable yoke member moves from said fourth position to said third position and is configured to prevent said secondary current from circulating along said damping coil, when said movable yoke member moves from said third position to said fourth position.

14. The contactor according to claim 2, wherein said excitation coil is wound around said fixed yoke member.

15. The contactor according to claim 3, wherein said excitation coil is wound around said fixed yoke member.

16. The contactor according to claim 2, wherein said damping coil is wound around said fixed yoke member.

17. The contactor according to claim 3, wherein said damping coil is wound around said fixed yoke member.

18. The contactor according to claim 1, wherein said damping coil is wound around the intermediate limb portion of said fixed yoke member.

19. The contactor according to claim 1, wherein said excitation coil is wound around the intermediate limb portion of said fixed yoke member.

20. The contactor, according to claim 1, wherein the damping circuit comprises a blocking circuit allowing a first current in a first direction during movement of the yoke member from the fourth position to the third position and blocking a second current in a second direction opposite the first direction.

21. The contactor, according to claim 1, wherein the damping circuit is configured with the conductive loop being a closed current path throughout movement of the yoke member from the third position to the fourth position.

22. The contactor, according to claim 1, wherein the damping circuit is configured with the conductive loop being a closed current path throughout movement of the yoke member from the fourth position to the third position.

23. The contactor, according to claim 1, wherein the damping circuit is configured with the conductive loop always being a closed current path.

* * * * *